US006674868B1

(12) United States Patent
Narusawa

(10) Patent No.: US 6,674,868 B1
(45) Date of Patent: Jan. 6, 2004

(54) HEARING AID

(75) Inventor: Hitoshi Narusawa, Oume (JP)

(73) Assignees: Shoei Co., Ltd., Tokyo (JP); Adphox Corporation, Tokyo (JP)

( * ) Notice: Subject to any disclaimer, the term of this patent is extended or adjusted under 35 U.S.C. 154(b) by 222 days.

(21) Appl. No.: 09/662,336

(22) Filed: Sep. 14, 2000

(30) Foreign Application Priority Data

Nov. 26, 1999 (JP) ..... 11-335950

(51) Int. Cl.[7] ..... H04R 25/00
(52) U.S. Cl. ..... 381/317; 381/320
(58) Field of Search ..... 381/312, 313, 381/316, 317, 318, 320, 321, FOR 108, FOR 119, FOR 131; 704/207, 208, 209, 225, 234, 268, 269

(56) References Cited

U.S. PATENT DOCUMENTS 4,051,331 A * 9/1977 Strong et al. ..... 381/320
5,479,560 A * 12/1995 Mekata ..... 704/209
5,737,719 A * 4/1998 Terry ..... 704/224
6,104,822 A * 8/2000 Melanson et al. ..... 381/320
6,353,671 B1 * 3/2002 Kandel et al. ..... 381/318

FOREIGN PATENT DOCUMENTS

EP 0 582 377 2/1994
WO WO/99/40755 8/1999

OTHER PUBLICATIONS

European Patent Office; Search Report; Apr. 4, 2003; pp. 1–4.

* cited by examiner

*Primary Examiner*—Curtis Kuntz
*Assistant Examiner*—Brian Ensey
(74) *Attorney, Agent, or Firm*—Staas & Halsey LLP

(57) ABSTRACT

The present invention is a hearing aid for amplifying an acoustic signals comprising: a controller for determining in real time a frequency band at the highest level of the acoustic signals through frequency analysis of the acoustic signals that vary over time, and for generating a control signal to raise a gain for signals of a higher frequency range than the frequency band at the highest level (such as an amplifier Q3, or a band-pass filter group 2 and a diode matrix 3 and a comparator 4, or a digital signal processor 13, or the like); and a first amplifier, in which the control signal from said controller is inputted so that the frequency characteristics are varied, for amplifying the acoustic signals by increasing the gain for signals of the higher frequency range than the frequency band at the highest level (such as an amplifier system consisting of amplifiers Q1 and Q2, or a parametric equalizer 5, or a digital signal processor 13, or the like). According to the present invention, the hearing aid can amplify a second formant signal without amplifying a first formant signal so that the output sound becomes clearer and not loud.

4 Claims, 9 Drawing Sheets

(1)
(2)
(3)
(4)
(5)
Level (dB)
0
-10
-20
-30
0
+10
0
+20
+10
0
Q1
Q2
Q1+(Q2+10 [dB])
Q1+(Q2+20 [dB])
Q1+(Q2+30 [dB])
Increase Point
100
200
500
1k
2k
5k
Frequency (Hz)

Q1
Q2+β
Q3
Input
0T
Output

Second Embodiment

FIG. 9

| | A | I | U | E | O |
|---|---|---|---|---|---|
| First Formant Frequency [kHz] | 1.0 | 0.35 | 0.4 | 0.6 | 0.5 |
| Second Formant Frequency [kHz] | 1.5 | 2.7 | 1.4 | 2.5 | 1.0 |
| Frequency Ratio | 1.5 | 7.7 | 3.5 | 4.17 | 2.0 |

HEARING AID

BACKGROUND OF THE INVENTION

1. Field of the Invention

The present invention relates to a hearing aid that improves clarity by minimizing the sense that sounds instantly become louder, eliminating the metallic ring to sounds, and so forth.

2. Description of the Related Art

The process by which sound waves are recognized by our auditory system is generally considered to be extremely complex, but to summarize this process, sound waves travel through a conducting system consisting of the external ear canal, the eardrum, the auditory ossicle, the cochlea, hair cells, nerves, and brain cells, where the sound waves are recognized. Within this conducting system, the external ear canal and eardrum are called the outer ear, the eardrum and auditory ossicle are called the middle ear, and the cochlea and hair cells are called the inner ear.

A hearing impairment therefore occurs when any of the functions is diminished in this conducting system, and the symptoms will vary, as will the method of dealing with them, depending on which function is diminished and to what extent.

The typical form of senile deafness is an overall decrease in function, including brain function, making it difficult to hear weak sounds.

FIG. 7 is a graph of equisignal curves of the loudness of sound in humans with normal hearing. The horizontal axis is the frequency (Hz), and the vertical axis is the sound pressure level (dB). Sound pressure level will hereinafter be abbreviated as SPL.

The curves in the graph are known as Fletcher-Manson curves, and the hatched area in the figure indicates the distribution of acoustic energy in a typical conversation. The dashed line labeled "minimum audible level" is a curve corresponding to a human with normal hearing, but in the elderly this is higher on the graph, as with the curve indicated by the dashed line labeled "senile deafness minimum audible level." This senile deafness minimum audible level varies from person to person, so the curve in the graph should be viewed as just an example.

As can be seen from the acoustic energy distribution in a typical conversation, a person with senile deafness is only able to hear about half of the sounds in the voice spectrum which a person with normal hearing is able to hear, so even though the sounds may be perceptible, the hearer cannot make out the words.

With the example shown in the graph, if the acoustic level is raised about 50 dB by a hearing aid, the voice spectrum of conversation will be more or less reach the audible level, allowing the wearer to understand the words, but sounds of, say, 80 dB, which are encountered on an everyday basis, become 130 dB, which is so loud as to be uncomfortable.

The highest level that a person with normal hearing is able to stand is about 130 dB, and is said to be between 120 and 130 dB for a person who is hard of hearing, which would seem to be about the same, but in fact the level is often much lower.

FIG. 8 is a graph of the formants of Japanese vowels. The horizontal axis is the first formant (kHz), and the vertical axis is the second formant (kHz) (see Rika Nenpyo, p. 491, published by Maruzen, Nov. 30, 1985).

What FIG. 8 tells us is that for the Japanese vowels "A", "I", "U", "E", and "O" to be clearly distinguished, for example, the second formant must be reliably transmitted with respect to the first formant.

FIG. 9 is a table of typical values for various sounds and their corresponding formant frequencies. According to this table, the second formant frequency varies between 1.5 and 7.7 times with respect to the first formant frequency, but if it is not reliably transmitted, the hearer cannot distinguish between A, I, U, E, and O.

In general, the level of the second formant is about 20 to 40 dB lower than the level of the first formant, so even if the first formant can be heard, it is difficult to hear the second formant, and to make matters worse, there is usually a dramatic drop in the perception of high frequencies with a person with senile deafness, as indicated by the dashed line in FIG. 7, and this makes it even more difficult to hear the second formant, in which case even though the person may be able to hear the first formant, he does not understand what is being said.

Conventional Approach 1

Because of the above situation, one thing conventional hearing aids had in common was that they raised the level of the second formant high enough to be audible, but while employing this means does indeed work fairly well with mild deafness, with more severe deafness the level of the first formant often exceeds 100 dB, which sounds loud to the wearer.

Conventional Approach 2

Raising the degree of amplification of high frequencies has been accomplished by using a tone control circuit, and while this is effective with persons of mild deafness, with a more severe case of deafness, if the frequency of the first formant is high, the first formant level can rise over 100 dB and become painful, and as a result the wearer hears a so-called ringing noise.

Conventional Approach 3

Automatic volume adjusting circuits are frequently used to keep the volume below 100 dB by immediately lowering the gain if a loud sound over 100 dB should come in. Various methods have been developed for shielding the wearer from fluctuations in sound level by optimizing the attack time and release time, but if someone should suddenly shout during a conversation, the level is lowered to the point that it sounds as if the sound source is far away, and this is particularly undesirable when listening to sounds through a stereo audio device because the sensation of a fixed position is lost and the location of the sound source seems to float around.

SUMMARY OF THE INVENTION

It is an object of the present invention to provide a hearing aid which amplifies voices so that they can be clearly understood but do not sound overly loud.

The hearing aid of the present invention is designed so that the gain of the second formant is raised without raising the gain of the first formant, which keeps the clarity of voices high without their sounding too loud. A state in which even the first formant cannot be heard is not under discussion here, in which case it is necessary to perform overall amplification so that the first formant can be heard, and raise the gain of the second formant.

The level of the first formant in conversation is usually about 50 to 60 dB, which is high, and even people with mild to moderate deafness can still hear adequately, but because the level of the second formant is about 20 to 40 dB lower than that of the first formant, voices will not seem too loud even if the second formant is boosted to about this same level.

Therefore, not raising the gain of the first formant and raising the gain of the second formant makes voices become clear, and since the gain of the first formant does not change, the voices do not sound loud.

FIG. 1 consists of graphs of the operating condition settings of the hearing aid pertaining to the present invention. The horizontal axis is frequency, and the vertical axis is the SPL. FIG. 1A shows the frequency spectrum related to the vowel "I" seen in FIG. 8, and FIG. 1B shows the frequency spectrum related to the vowel "A" seen in FIG. 8.

For example, if a person cannot hear sounds below an SPL of 50 dB, then, as is obvious from FIG. 1A, that person can only hear the first formant with the vowel "I" and cannot, tell which sound it is, further since he can faintly hear the second formant with the vowel "A" as shown in FIG. 1B, he can tell that the sound is "A", although he will be uncertain if the voice is a little softer.

With the hearing aid pertaining to the present invention, as shown by the broken line in FIG. 1A and 1B, the first formant is not amplified, and just the second formant is amplified enough to reach the required level, thus bringing both the first formant and second formant within the audible range.

With the "I" sound in FIG. 1A, frequencies of the 350 Hz frequency of the first formant and higher are corrected by 6 dB/oct up to a maximum of 20 dB.

This correction strengthens the second formant (2.7 kHz, SPL of 42 dB) by 18 dB, bringing it up to SPL of 60 dB, so a person who cannot hear below an SPL of 50 dB can adequately catch the first and second formants and is able to tell that the sound is "I." The corrected frequency spectrum is indicated by a one-dot chain line in FIG. 1A.

With the "A" sound in FIG. 1B, frequencies of the 1 kHz frequency of the first formant and higher are corrected by 6 dB/oct up to a maximum of 20 dB.

With the sound "A," even without correction, a person who cannot hear below an SPL of 50 dB can tell that the sound is "A" if he pays close attention, since the second formant is 53 dB, but the level rises to SPL 57 dB with correction, which allows the sound to be heard more clearly. Again in FIG. 1B, the corrected frequency spectrum is indicated by a one-dot chain line.

A feature of the correction characteristics in the hearing aid of the present invention is that they change in relation to the change in the first formant frequency. In the past, when frequency characteristics were corrected by tone control or the like, the correction characteristics themselves did not change when the first formant changed.

For instance, when a conventional tone control is used to set the correction characteristics to match the frequency spectrum of the sound "I" seen in FIG. 1A (that is, the correction characteristics indicated by the broken line of FIG. 1A), and the wearer hears the sound "A" in this state, 1 kHz, which is the first formant of the sound "A" as shown in FIG. 1B, is strengthened by 10 dB, bringing the SPL of first formant up to 80 dB and making the sound "A" 10 dB louder than the sound "I." This results in a so-called ringing noise because the degree of amplification for first formant rises along with the frequency of the first formant rises as the sound "A".

Because the extent of hearing impairment can vary widely, correction of a hearing aid must be matched to the extent of impairment of the user, and therefore the amount of correction must be matched to the user, and cannot be fixed.

When correction is thus tailored to the extent of impairment of the user, if the user cannot hear even the first formant, then first of all amplification must be performed for all frequencies up to the level where the first formant can be heard, and then the corrective amplification for the second formant pertaining to the present invention must be performed.

The first and second formants described above are the minimum elements required to understand language, and useful information is also contained in the third, fourth, and subsequent formants, so reproducing these is also important, and since these are contained in substantially higher frequencies than the first formant, the correction pertaining to the present invention is effective with them as well.

The above description is focused primarily on language, but being able to hear frequencies over the first formant is effective for musical notes and all information obtained from sound waves and required in our daily lives, and makes it possible to obtain more information.

Because of the above, first aspect of the present invention is a hearing aid for amplifying an acoustic signals:

(1) comprising:

a controller for determining in real time a frequency band at the highest level of the acoustic signals through frequency analysis of the acoustic signals that vary over time, and for generating a control signal to raise a gain for signals of a higher frequency range than the frequency band at the highest level (such as an amplifier Q3, or a band-pass filter group 2 and a diode matrix 3 and a comparator 4, or a digital signal processor 13, or the like); and a first amplifier, in which the control signal from said controller is inputted so that the frequency characteristics are varied, for amplifying the acoustic signals by increasing the gain for signals of the higher frequency range than the frequency band at the highest level (such as an amplifier system consisting of amplifiers Q1 and Q2, or a parametric equalizer 5, or a digital signal processor 13, or the like), or (2) in (1) above, the controller comprising a second amplifier whose gain is a function of the frequency (such as the amplifier Q3), or (3) in (1) above, the first amplifier, comprising an amplification apparatus (such as an amplification apparatus including amplifiers Q1 and Q2) in which a plurality of sub-amplifiers with different frequency characteristics, each capable of gain control, are connected in parallel, and the outputs of the plurality of sub-amplifiers are added together, or (4) in (1) above, the controller comprising a band-pass filter group (such as the band-pass filter group 2), a diode matrix (such as the diode matrix 3), and a comparator group (such as the comparator group 4), or (5) in (1) above, the first amplifier, comprising a parametric equalizer, or (6) comprising:

an A/D converter provided on the side where the acoustic signals are inputted, for converting analog signals of the acoustic signals into digital signals (such as an A/D converter 12);

a digital signal processor for determining in real time a frequency band at the highest level of the digital signals through frequency analysis of the digital signals that are outputted from the A/D converter and vary over time, and then for generating a control signal for raising a gain for signals of a higher frequency range than the signal of the frequency band at the highest level, and then for amplifying the digital signals by increasing the gain for signals of the higher frequency range than the frequency band at the highest level, according to the control signal; and a D/A converter for converting the digital signals outputted from the digital signal processor into analog signals (such as a D/A converter 14).

The adoption of the above structure results in a hearing aid which amplifies an input acoustic signals so that all sounds can be clearly understood but do not sound overly loud.

The second aspect of the present invention is a hearing aid for amplifying an input acoustic signals that vary over time comprising:

a control circuit for generating a control signal according to a first frequency band at the highest level of the input acoustic signals; and an amplifier for amplifying the input acoustic signals so as to generate an output acoustic signals, wherein the amplifier has a frequency characteristic including a first gain region which has a constant gain for frequencies equal to or lower than the first frequency band, and a second gain region whose gain increases higher than the first gain region, according to frequency, for frequencies higher than the first frequency band; and in response to the control signal, an increase point between the first and second gain regions changes according to the first frequency band.

The frequency characteristic for the gain is dynamically controlled depending on the first frequency band at the highest level of the input acoustic signals so that the increase point between the flat gain region and the increasing gain region changes dynamically.

BRIEF DESCRIPTION OF THE DRAWINGS

FIG. 9 FIG. 9 is a table of typical values for various sounds and their corresponding formant frequencies.

DESCRIPTION OF THE PREFERRED EMBODIMENTS

The hearing aid pertaining to the present invention should have an amplification system that allows the principle of the present invention as described above to be realized, and while this amplification system must be one with which the frequency characteristics can be varied, many conventional means are known for varying the frequency characteristics.

Figure 1A:
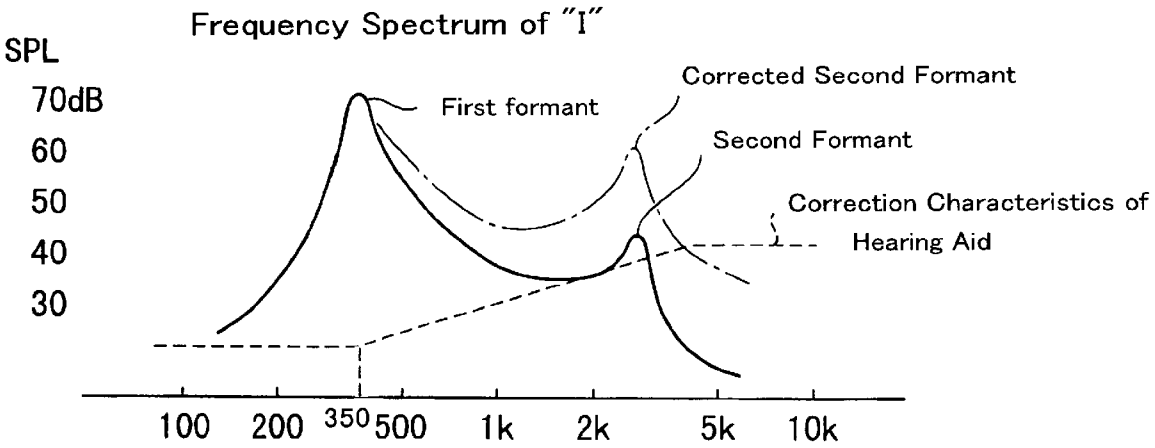
FIGS. 1A and 1B are graphs of the operating condition settings of the hearing aid pertaining to the present invention.
Figure 1B:
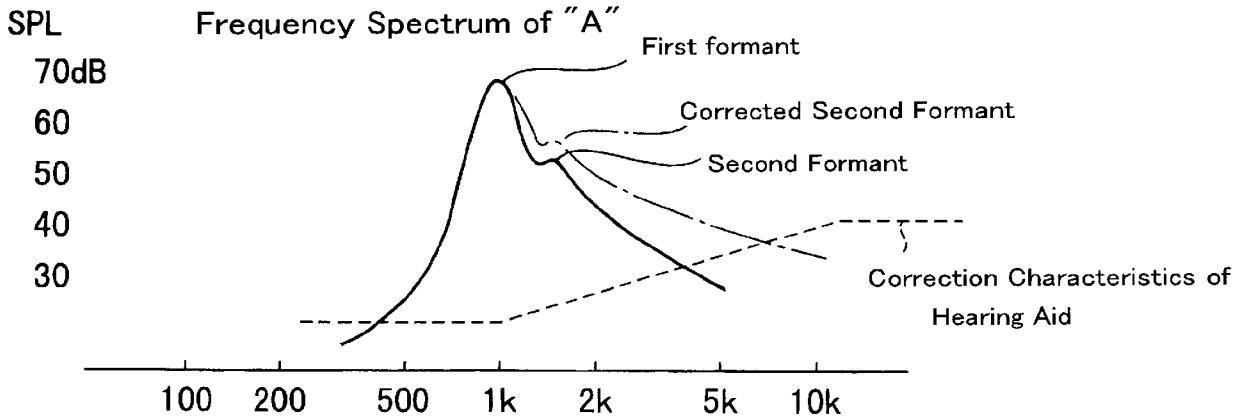
Figures 2A, 2B:
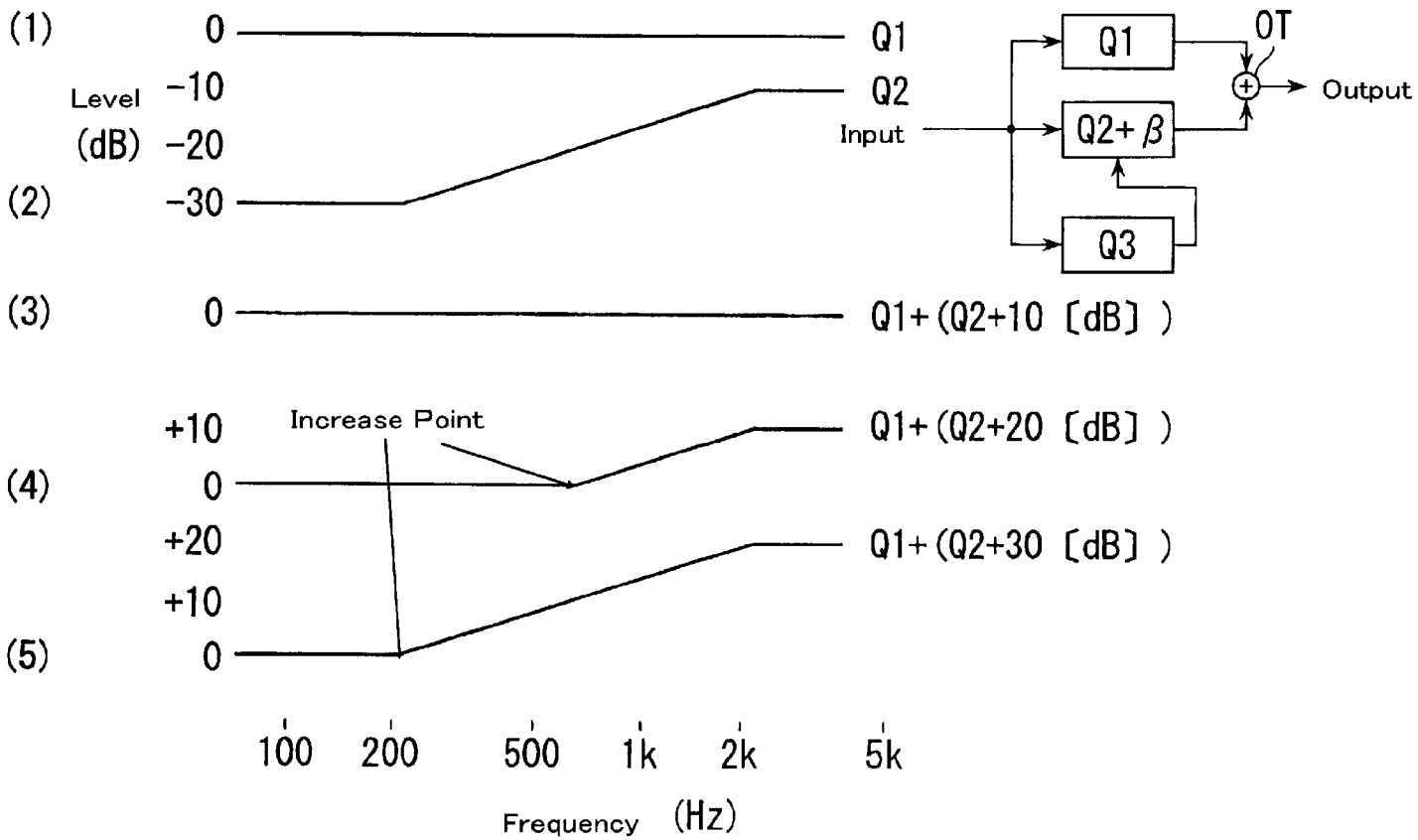
FIGS. 2A and 2B are diagram illustrating an amplification system for constituting Embodiment 1 in the present invention.

FIG. 2 is a diagram illustrating an amplification apparatus for constituting Embodiment 1 in the present invention. FIG. 2A is a graph of the frequency characteristics and FIG. 2B is a block diagram of the structure of the amplification apparatus. An input acoustic signal IN amplified by Q1 and Q2 to generate an output signal OUT.

In the figures, Q1 is an amplifier having the frequency characteristics seen in (1) of FIG. 2A, Q2 is an amplifier having the frequency characteristics seen in (2) of FIG. 2A, Q3 is an amplifier that controls the amplifier Q2, TO is an output terminal of the amplification apparatus, and β is the corrected gain of the amplifier Q2.

The amplification apparatus consists of the amplifiers Q1 and Q2 connected in parallel, and the amplifier Q3 that controls the corrected gain β of the amplifier Q2. The combined output of the amplifiers Q1 and Q2 is outputted from the output terminal TO.

The amplifier Q2 is designed so that its gain is controlled to be varied according to the output corresponding to the first formant frequency from the amplifier Q3, and the frequency characteristics seen in (3), (4), and (5) of FIG. 2A can be achieved. That is, when β is controlled to be 10 dB, the frequency characteristics is (3), when β is controlled to be 20 dB, it is (4), and when β is controlled to be 30 dB, it is (5).

The characteristics of the amplifier Q1 are dominant if the gain of the amplifier Q2+β is low, but the characteristics of the amplifier Q2+β are dominant if the gain of the amplifier Q2+β exceeds the gain of the amplifier Q1 over the entire frequency band, between which the gain varies smoothly and the frequency at which the gain correction for higher frequency begins varies from (3) to (5) depending on the first formant frequency, so this is favorable as the characteristic correction amplification system of the present invention.

As can be seen from FIG. 2, the characteristics of the amplifier Q2 are corrected by 20 dB between 200 Hz and 2 kHz, but the amount of correction should be determined according to the level of the person who is hard of hearing, and is not limited to 20 dB.

Figure 3:
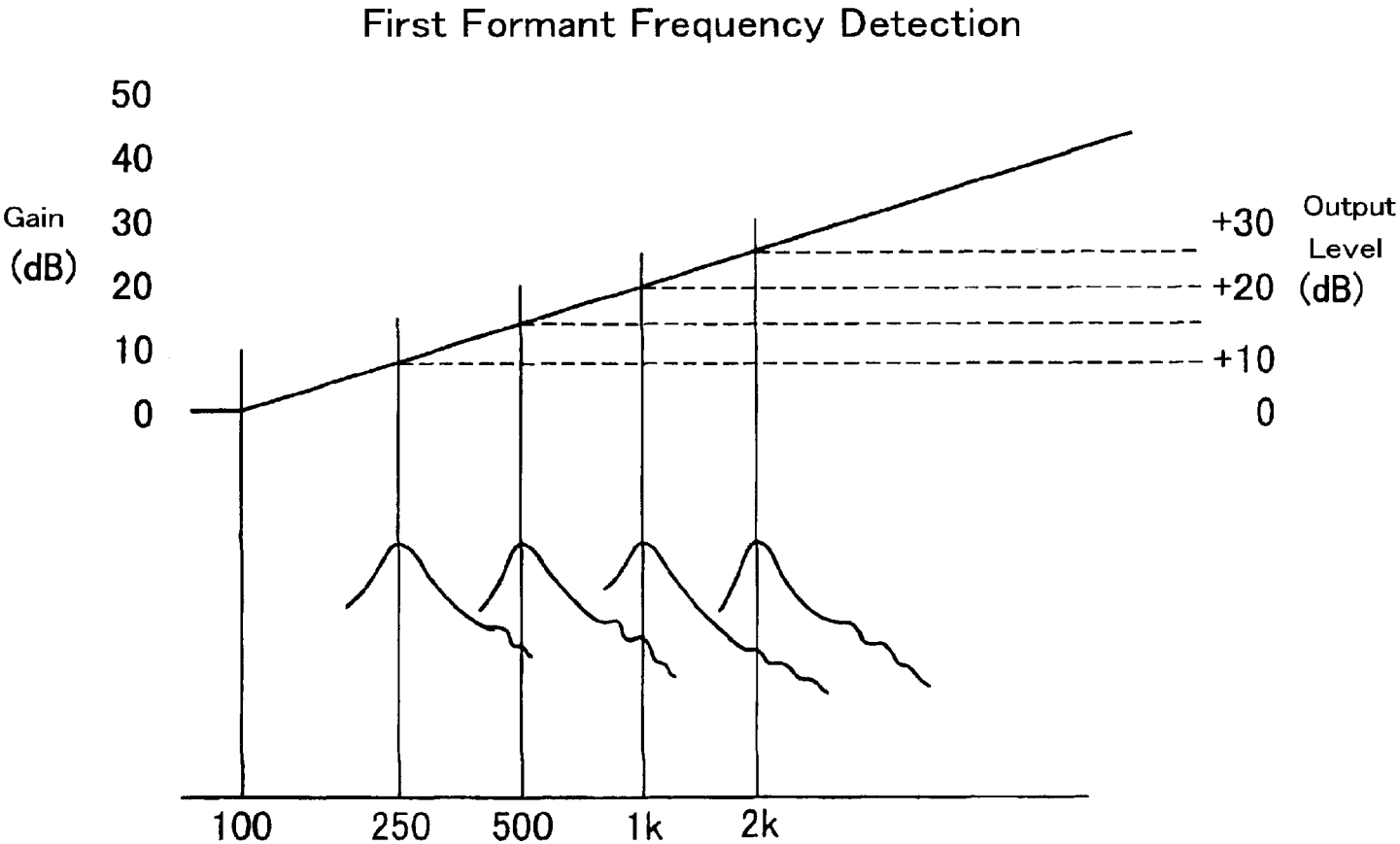
FIG. 3 is a diagram illustrating first formant frequency detection by the amplifier Q3 seen in FIG. 2.

FIG. 3 is a diagram illustrating first formant frequency detection by the amplifier Q3 shown in FIG. 2. The horizontal axis is frequency, the left vertical axis is gain, and the right vertical axis is output level.

It is clear from the characteristics lines indicated by the symbol Q3 in FIG. 3 that the amplifier Q3 is one in which gain increases linearly by 6 dB/oct, and when a voice signal is added, the degree of amplification increases and output goes up as the first formant frequency rises.

That is, when the input signal of vowel "I" is supplied to the amplifier Q3, since the gain for the frequency of the first formant of "I" is lower, the output of the amplifier Q3 is automatically lower so that β of the amplifier Q2 is controlled to be higher. On the other hand, when the input signal of vowel "A" is supplied to the amplifier Q3, since the gain for the frequency of the first formant of "A" is higher, the output of the amplifier Q3 is automatically higher so that β of the amplifier Q2 is controlled to be lower. Therefore, the amplifier Q3 virtually detects a first formant frequency of the input acoustic signals, then generates a control signal to change β of the amplifier Q2.

As described for FIG. 2, this output of Q3 changes the characteristics of the amplification system (Q1+Q2+β). Specifically, it results in the following.

First formant frequency:

250 Hz or lower: the characteristics (5) in FIG. 2A

600 Hz: the characteristics (4) in FIG. 2A 2 kHz or higher: the characteristics (3) in FIG. 2A According to the above explanation, when the first formant frequency is lower, the total gain of the amplification system increases from a lower frequency as (5). And, when the first formant frequency is higher, the starting frequency for gain increases is higher as (4), (3).

As explained above, the amplification system (Q1+Q2+β) has a frequency characteristic including a first gain region which has a constant gain for frequencies equal to or lower than the frequency band of the first formant, and a second gain region whose gain increases higher than the first gain region, according to frequency, for frequencies higher than the frequency band of the first formant; and an increase point between the first and second gain regions changes according to the frequency band of the first formant. The frequency of the first formant can be detected as the frequency band of the highest level signal. The increase point becomes higher when the frequency band of the highest level signal becomes higher, and the increase point becomes lower when the frequency band of the highest level signal becomes lower. Such increase point changes in response to the control signal generated by the amplifier Q3.

The hearing aid described for FIGS. 2 and 3 is a simple model made up of analog circuitry, but since it is practical, there is no delay in signal processing attendant to digital processing, and there is no omission of very faint signals of 1 bit or less; the location of a sound source can be accurately recognized when the hearing aid is used in both ears, so that the surrounding situation can be assessed by sound.

Figure 4:
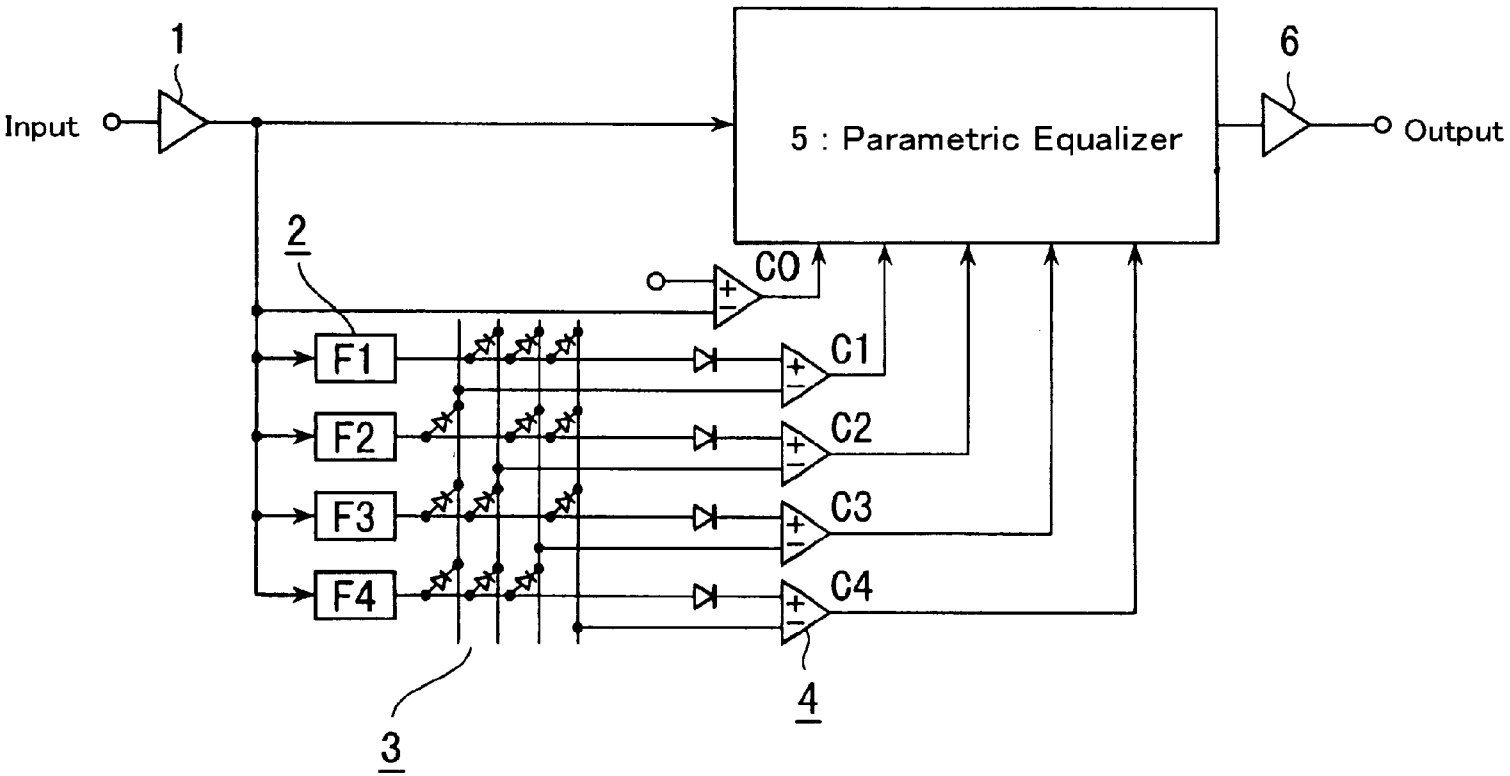
FIG. 4 is a block diagram of the main elements and serves to illustrate the hearing aid in Embodiment 2 of the present invention.

FIG. 4 is a block diagram of the main elements and serves to illustrate the hearing aid in Embodiment 2 of the present invention. In this figure, 1 is an input amplifier, 2 is a band-pass filter group, 3 is a diode matrix, 4 is a comparator group, 5 is a parametric equalizer (parametric amplifier), and 6 is an output amplifier. The band-pass filter group 2 is made up of band-pass filters F1, F2, F3, and F4, and the comparator group 4 is made up of comparators C0, C1, C2, C3, and C4.

Figure 5A:
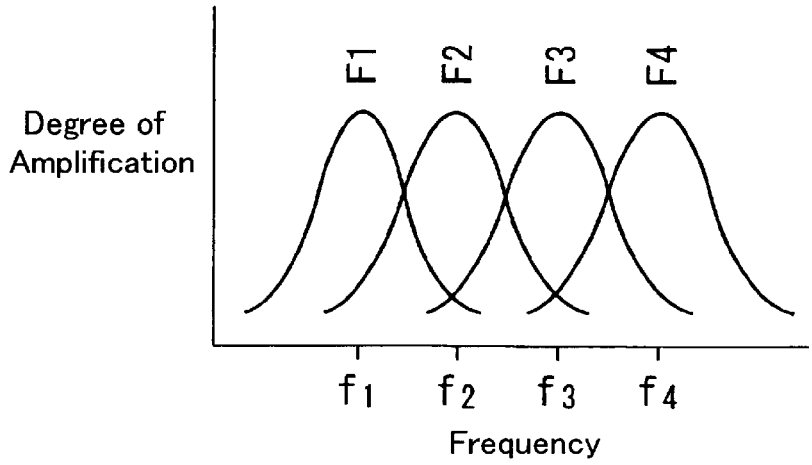
FIGS. 5A and 5B are graphs illustrating the characteristics of the main structural elements in the hearing aid seen in FIG. 4.
Figure 5B:
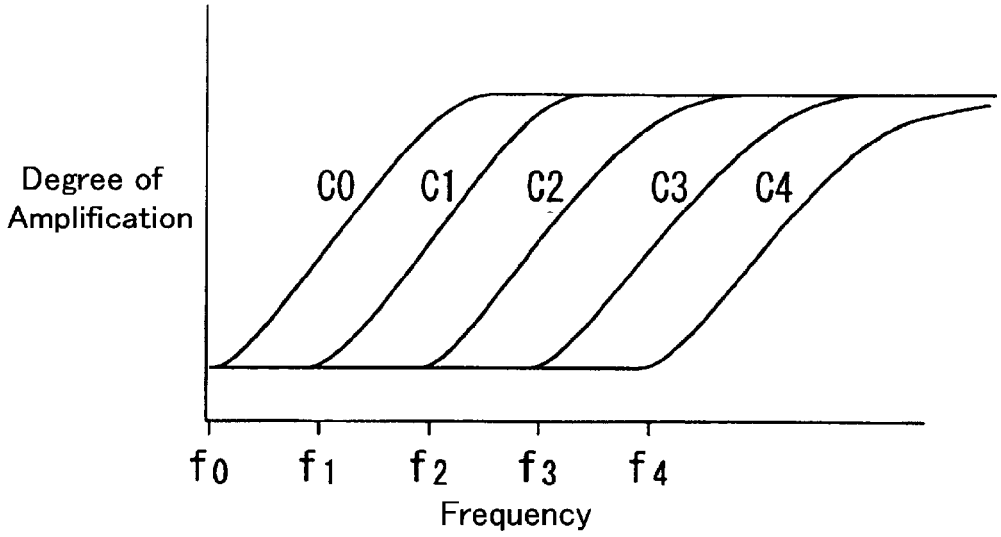

FIGS. 5A and 5B are graphs illustrating the characteristics of the main structural elements in the hearing aid seen in FIG. 4. FIG. 5A is a graph of the characteristics of the band-pass filters, and FIG. 5B is a graph of the characteristics of the parametric equalizer. In both graphs, the horizontal axis is frequency and the vertical axis is degree of amplification. The symbols appended to the characteristic lines correspond to the characteristics of the elements in FIG. 4 labeled with the same symbols. $f_1$, $f_2$, $f_3$, and $f_4$ are the center frequencies of the band-pass filters F1, F2, F3, and F4.

It is well known that the comparators C1 to C4 in the hearing aid seen in FIG. 4 compare the voltage of two input terminals and generate their output. If the voltage of the positive terminal is greater than that of the negative terminal, the output will be positive, otherwise the output will be negative.

If the output voltage of the band-pass filter F2 is greater than the output voltage of the other band-pass filters, then the output of the comparators is determined by the comparator terminal to which the voltage of the band-pass filter F2 is applied.

For instance, the voltage from the band-pass filter F2 is applied to the positive terminal with the comparator C2, but with the other comparators C1, C3, and C4, it is applied to the negative terminal, according to the action of the diode matrix 3 so if the output voltage of the band-pass filter F2 is higher than the output of the other band-pass filters, just the output of the comparator C2 becomes positive, and the output of the other comparators becomes negative.

Therefore, if the highest signal level of the input signal has the center frequency $f_2$ of the band-pass filter F2, or a frequency close thereto, the output of the comparator C2 becomes positive, and if the highest signal level of the input signal has the center frequency $f_3$ of the band-pass filter F3, or a frequency close thereto, the output of the comparator C3 becomes positive.

It is a well-known fact that a parametric equalizer, that is, a parametric amplifier, can vary characteristics from the outside, and the parametric equalizer 5 shown in FIG. 4 serves to raise the degree of amplification of frequencies higher than the center frequency $f_1$ when the output of the comparator C1 is positive, as seen in FIG. 5B.

Similarly, it serves to raise the degree of amplification of frequencies higher than the center frequency $f_2$ when the output of the comparator C2 is positive, to raise the degree of amplification of frequencies higher than the center frequency $f_3$when the output of the comparator C3 is positive, and to raise the degree of amplification of frequencies higher than the center frequency $f_4$ when the output of the comparator C4 is positive.

The frequency characteristics in the hearing aid of FIG. 4 may be any of the characteristics of the parametric equalizer 5 seen in FIG. 5B, and which characteristics they become is determined by the input signals.

If the level of the input signal is lower than the specified level, the output of the comparator C0 becomes positive, the characteristics of the parametric equalizer 5 become C0 in FIG. 5B, and just the frequencies higher than $f_0$ are amplified, but if the input signal is over the specified level, the characteristics are determined by the frequency with the most energy out of the frequencies included in the input signal. For instance, if this frequency is $f_1$, then frequencies lower than $f_1$ are not amplified, and just those frequencies higher than $f_1$ are amplified.

Similarly, if the frequency is $f_2$, $f_3$, or $f_4$, then frequencies lower than $f_2$, lower than $f_3$, or lower than $f_4$ are correspondingly not amplified, and only input signals whose frequency is higher than these are amplified.

In the descriptions above, the frequency band being used is divided up into four bands for easy understanding, but one band generally consists of one third of an octave or one sixth of an octave.

Therefore, in the case of 300 to 2400 Hz (3 octaves), the frequency would be divided into 9 or 18 bands, and even when the frequency is thus divided into numerous bands, band-pass filters can be easily configured as active filters with existing integrated circuit technology, and even the comparators and parametric equalizer can be easily integrated together with them.

The slope of the correction characteristics in the hearing aid of the present invention is generally 6 dB/oct or 12 dB/oct, and the maximum amount of correction is 20 to 30 dB, but these refer to correcting the characteristics of the user's ear, and since there are individual differences, optimal results will be obtained by tailoring these values to the individual.

Incidentally, electronic devices that are extremely useful in carrying out the acoustic signal processing required for the hearing aid have now become practical, an example of which is a digital signal processor (DSP). A DSP can be programmed to operate as a variety of electronic devices, such as a spectrum analyzer or a parametric equalizer.

Figure 6:
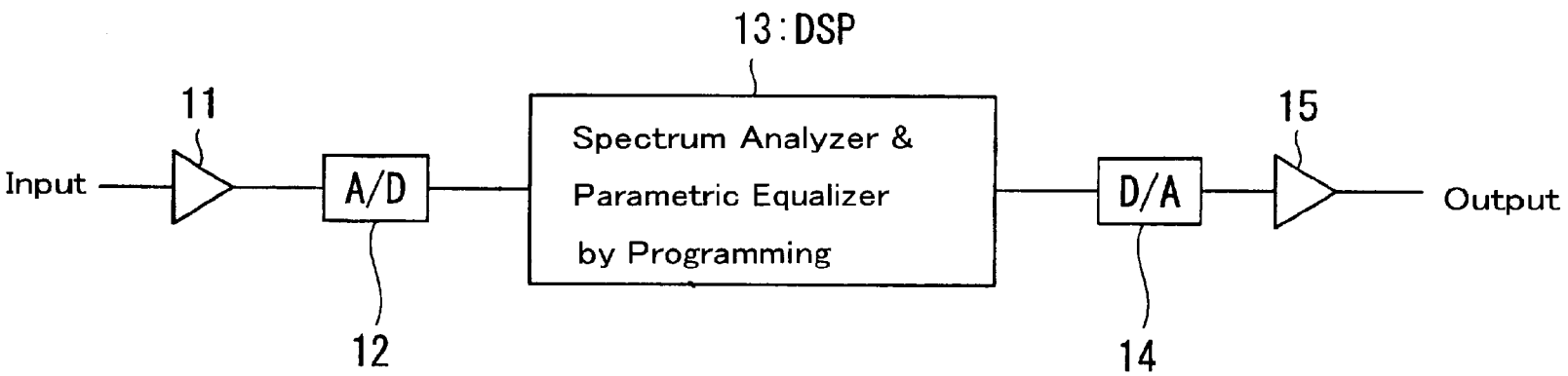
FIG. 6 is a block diagram of the main elements and serves to illustrate the hearing aid in Embodiment 3 of the present invention.
Figure 7:
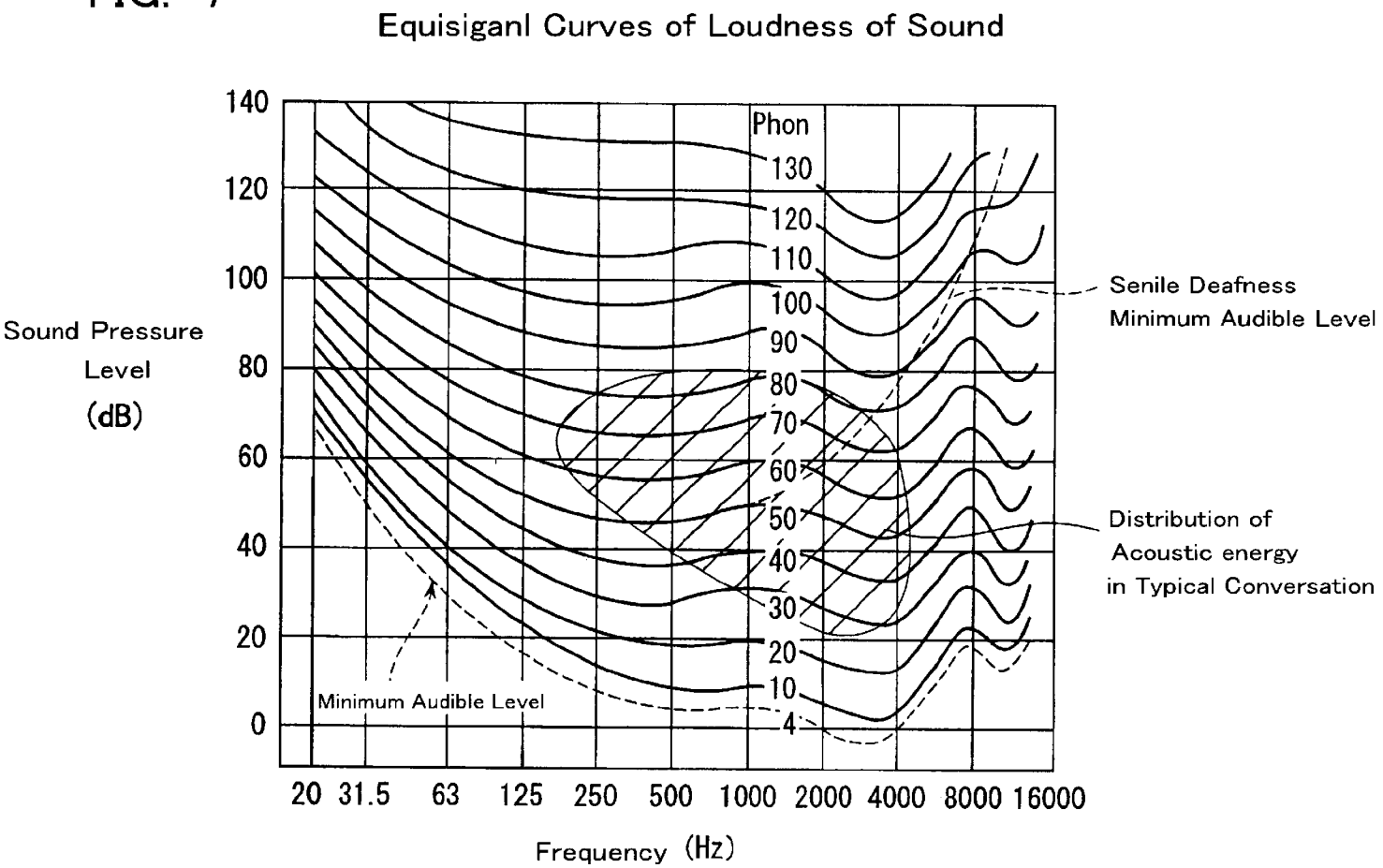
FIGS. 7 is a graph of equisignal curves of the loudness of sound in humans with normal hearing.
Figure 8:
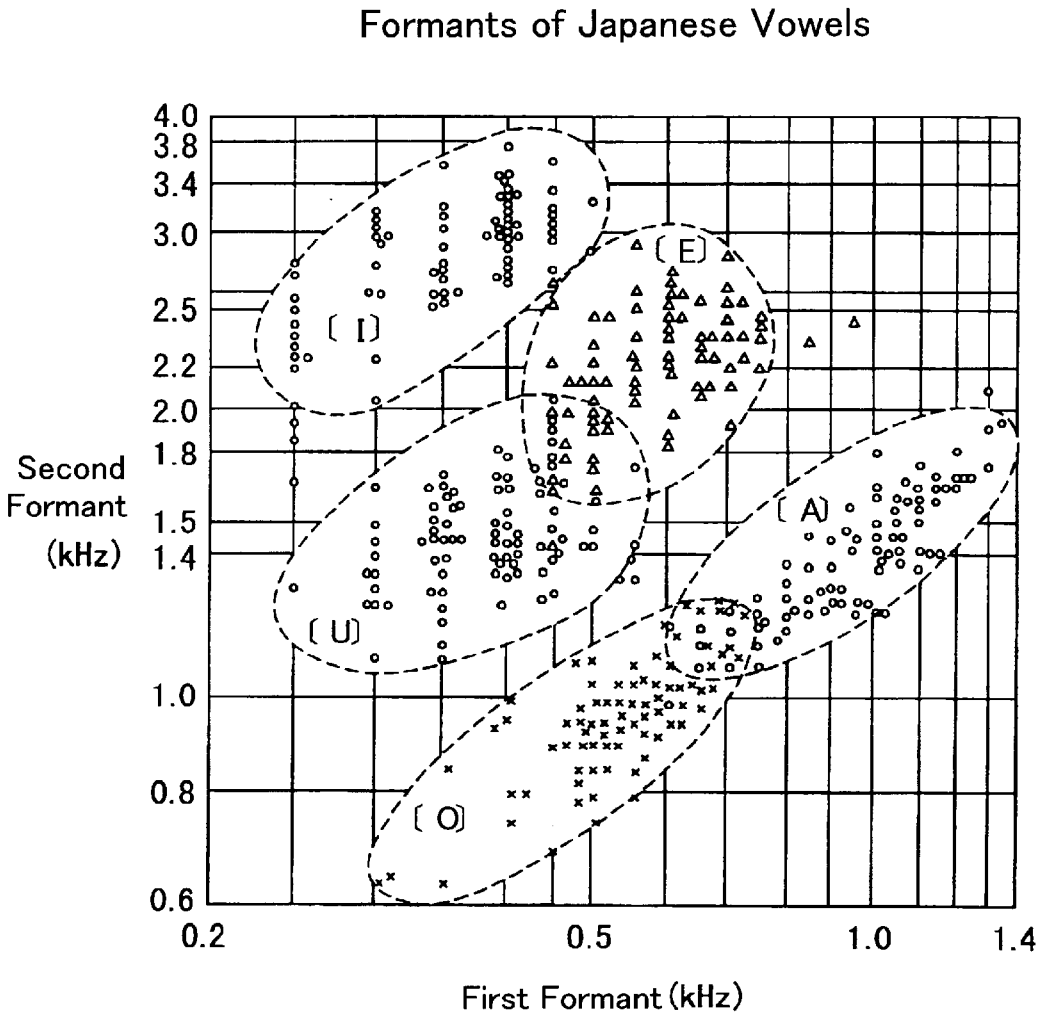
FIG. 8 is a graph of the formants of Japanese vowels.

FIG. 6 is a block diagram of the main elements and serves to illustrate the hearing aid in Embodiment 3 of the present invention. In this figure, 11 is an input amplifier, 12 is an A/D converter, 13 is a DSP, 14 is a D/A converter, and 15 is an output amplifier.

With this hearing aid, the input signal is passed through the input amplifier 11 so as to maintain the first formant frequency at a specific audible level, this amplified signal is digitized by the A/D converter 12, and this digital signal is inputted to the DSP 13.

By preprogramming the DSP 13, it can act as a spectrum analyzer to perform frequency analysis, the digital data thus obtained is computed, and this DSP 13 then acts as a parametric equalizer to amplify and correct just the signals of the second formant frequency and send out a signal.

The signal corrected and amplified by the DSP 13 is converted back into an analog signal by the D/A converter 14, and reaches the ear of the user after being suitably amplified by the output amplifier 15.

The hearing aid pertaining to the present invention comprises a controller for determining in real time a signal with a frequency band at the highest level of the acoustic signals through frequency analysis of the acoustic signals that vary over time, and for generating a control signal to raise a gain of signals of a higher frequency range than the signal of the frequency band at the highest level, and a first amplifier, in which a control signal from the controller is inputted so that the frequency characteristics are varied, for amplifying the acoustic signal by increasing the gain for signals of the higher frequency range than the signal of the frequency band at the highest level.

The adoption of the above structure results in a hearing aid which amplifies all sounds so that they can be clearly understood but do not sound overly loud.

What is claimed is:

1. A hearing aid for amplifying acoustic signals, comprising:

a controller for detecting in real time a frequency band at the highest level of the acoustic signals through frequency analysis of the acoustic signals that vary over time, and for generating a control signal to raise a gain for signals of a higher frequency range than the detected frequency band at the highest level; and a first amplifier, in which the control signal from said controller is inputted, for amplifying the acoustic signals by increasing the gain for signals of the higher frequency range than the frequency band, wherein frequency characteristics of the first amplifier are controlled depending on the detected frequency band, and wherein the controller comprises a second amplifier whose gain is a function of the frequency.

2. A hearing aid for amplifying an acoustic signals comprising:

a controller for determining in real time a frequency band at the highest level of the acoustic signals through frequency analysis of the acoustic signals that vary over time, and for generating a control signal to raise a gain for signals of a higher frequency range than the frequency band at the highest level; and a first amplifier, in which the control signal from said controller is inputted so that the frequency characteristics are varied, for amplifying the acoustic signals by increasing the gain for signals of the higher frequency range than the frequency band at the highest level, and wherein the first amplifier, comprises an amplification apparatus in which a plurality of sub-amplifiers with different frequency characteristics, each capable of gain control, are connected in parallel, and the outputs of the plurality of sub-amplifiers are added together.

3. A hearing aid for amplifying an acoustic signals comprising:

a controller for determining in real time a frequency band at the highest level of the acoustic signals through frequency analysis of the acoustic signals that vary over time, and for generating a control signal to raise a gain for signals of a higher frequency range than the frequency band at the highest level; and a first amplifier, in which the control signal from said controller is inputted so that the frequency characteristics are varied, for amplifying the acoustic signals by increasing the gain for signals of the higher frequency range than the frequency band at the highest level, and wherein said controller comprises a band-pass filter group, a diode matrix, and a comparator group.

4. A hearing aid for amplifying an acoustic signals comprising:

a controller for determining in real time a frequency band at the highest level of the acoustic signals through frequency analysis of the acoustic signals that vary over time, and for generating a control signal to raise a gain for signals of a higher frequency range than the frequency band at the highest level; and a first amplifier, in which the control signal from said controller is inputted so that the frequency characteristics are varied, for amplifying the acoustic signals by increasing the gain for signals of the higher frequency range than the frequency band at the highest level, and wherein said first amplifier comprises a parametric equalizer.

* * * * *